US005821961A

United States Patent [19]

Sato

[11] Patent Number: 5,821,961

[45] Date of Patent: Oct. 13, 1998

[54] INK JET HEAD HAVING A POSITIONING REFERENCE PORTION, AND INK JET APPARATUS USING SAME

[75] Inventor: Osamu Sato, Kawasaki, Japan

[73] Assignee: Canon Kabushiki Kaisha, Tokyo, Japan

[21] Appl. No.: 562,365

[22] Filed: Nov. 22, 1995

[30] Foreign Application Priority Data

Nov. 22, 1994 [JP] Japan ..... 6-312437

[51] Int. Cl.[6] ..... B41J 2/05

[52] U.S. Cl. ..... 347/63

[58] Field of Search ..... 347/63, 47, 20, 347/68, 69

[56] References Cited

U.S. PATENT DOCUMENTS 4,701,766 10/1987 Sugitani et al. ..... 347/47

5,095,321 3/1992 Saito et al. ..... 347/63

5,478,606 12/1995 Ohkuma et al. ..... 347/20 X 5,657,539 8/1997 Orikasa et al. ..... 219/121.71

*Primary Examiner*—Edward Tso

*Attorney, Agent, or Firm*—Fitzpatrick, Cella, Harper & Scinto

[57] ABSTRACT

An ink jet head includes ink paths in fluid communication with to ejection orifices for ejecting ink; a liquid chamber for supplying the ink to the ink paths; energy generation elements for generating energy for ejecting the ink; a substrate comprising the energy generation elements; and a top plate comprising recesses constituting the ink paths and the liquid chamber, and an ejection orifice plate comprising the ejection orifices; wherein the ink paths and liquid chamber are formed by the recesses and substrate, and a positioning reference portion of the ink jet head relative to an ink jet apparatus is provided on the top plate.

11 Claims, 5 Drawing Sheets

INK JET HEAD HAVING A POSITIONING REFERENCE PORTION, AND INK JET APPARATUS USING SAME

FIELD OF THE INVENTION AND RELATED ART

The present invention relates to an ink jet head, which records images by ejecting liquid droplets from its ejection orifices.

An ink jet head cartridge (hereinafter, head cartridge) integrally comprising an ink ejection section for forming ink droplets, and an ink container for supplying ink to the ink ejection section, has been in practical use for some time.

It has been customary that when such a head cartridge is mounted in an ink jet apparatus, with which the head cartridge is used, it is mounted on the carriage of the ink jet apparatus, and its position thereon is fixed using the external configuration of the ink container, support members of the head cartridge, or the like.

In this case, the positioning accuracy of the head cartridge relative to the carriage is necessarily rather high, that is, positioning error must be within +10 $\mu$m, so that the horizontal rules of a table, for example, do not become displaced.

FIG. 5 is an exploded schematic view of the ink ejection section of a head cartridge which has been conventionally used, and its adjacencies. In the drawing, a reference numeral 100 designates a heater board comprising energy generation elements (unillustrated) for generating the energy used for ejecting ink. The heater board 100 is fixed on a support member 300, with adhesive 306. A reference numeral 1300 designates a grooved top plate comprising a recess constituting a part of a common liquid chamber 1301, and an ejection orifice plate 400, in which ejection orifices 30 are formed. The grooved top plate 1300 further comprises an ink entrance port 1500, through which ink is supplied to the common liquid chamber 1301, and recesses (unillustrated) constituting parts of ink paths, which connect the common liquid chamber 1301 and ejection orifices 30. The grooved top plate 1300 is joined with the heater board 100, using adhesive 405, being positioned so that the energy generation elements and ink paths are accurately matched one for one. When the head cartridge described above is mounted in an ink jet apparatus, its position relative to the ink jet apparatus is fixed based on a reference 300T, which is a reference in the ink ejection direction, a reference 300C, which is a reference in the direction perpendicular to the line of ejection orifice alignment, and positioning projections 2500 and 2600, which comprise the reference in the direction perpendicular to both of the preceding directions. Therefore, when the support member 300, heater board 100, and grooved top plate 1300 of the conventional type were joined together, the positional relationship among them had to be fixed using a highly accurate positioning method such as image processing or the like.

However, a conventional head cartridge, although it was assembled while paying exacting attention to positioning accuracy as described above, still had to be frequently inspected for its dimensional accuracy, so that it could be accurately positioned on the carriage in an ink jet apparatus. This was due to the following reason; the structure of the conventional head cartridge was such that the heater board was glued on the support member, and then, the top plate was glued thereon, as described above. In other words, the support member, the heater board, and the top plate were joined using adhesive, which was difficult to manipulate for dimensional accuracy. Therefore, the conventional head cartridge had to be assembled using extremely high precision assembly equipment, or it had to be re-processed after the inspection, to improve its dimensional and positional accuracy. As a result, it was practically difficult to produce inexpensively the conventional head cartridge.

Further, when plural conventional head cartridges were positioned on the carriage to print in color, the positional relation among the plural cartridges had to be adjusted so that all the ejection orifices were correctly aligned. Therefore, the number of production steps had to be increased, preventing production cost reduction.

SUMMARY OF THE INVENTION

Accordingly, it is an object of the present invention to provided a head cartridge, which can be inexpensively produced without using extremely high precision assembly equipment.

According to an aspect of the present invention, there is provided an ink jet head comprising: ink paths in fluid communication with to ejection orifices for ejecting ink; a liquid chamber for supplying the ink to the ink paths; energy generation elements for generating energy for ejecting the ink; a substrate comprising the energy generation elements; and a top plate comprising recesses constituting the ink paths and the liquid chamber, and an ejection orifice plate comprising the ejection orifices; wherein the ink paths and liquid chamber are formed by the recesses and substrate, and a positioning reference portion of the ink jet head relative to an ink jet apparatus is provided on the top plate.

It is preferable that the positioning reference portion are formed as integral parts of the top plate, so that its accuracy can be easily attained.

The positioning reference portion is constituted of a minimum of one positioning reference among three positioning references: the positioning reference in the ink ejection direction, the positioning reference in the direction perpendicular to the line of ink ejection orifice alignment, and the positional reference perpendicular to both of the preceding directions.

All of the positioning references of the positioning reference portion may be concentrated in a single specific location of the top plate.

The structure of the positioning reference portion may be such that the positioning reference in the direction perpendicular to the aforementioned two directions is formed on a minimum of one positioning projection projecting from the top plate, wherein the positioning projections may be projecting vertically or from the top plate.

According to the present invention, the positioning references of the head cartridge relative to the ink jet apparatus are formed on the top plate in which the ejection orifices are formed. Therefore, an accurate positional relationship between the ejection orifices and the positioning references can be easily established. Also, when the ejection orifices are formed as accurately positioned integral parts of the grooved top plate, it becomes unnecessary to subject the positioning reference portion to a re-processing step. Consequently, a head cartridge of good quality can be inexpensively produced without a need for costly high precision assembly equipment.

Further, according to the present invention, all positioning references are concentrated in a single specific portion of the top plate; therefore, it is far easier to form them precisely in terms of dimension as well as position, and also, the positioning references on the carriage side can be concentrated in a single specific portion of the carriage, making it easier to attach them. As a result, not only can the head cartridge be inexpensively produced, but also, the ink jet recording apparatus itself can be inexpensively produced.

Further, when plural ink jet head cartridges are mounted on the carriage, their positional relationship can be easily adjusted to accurately align all the ejection orifices.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Hereinafter, the embodiments of the present invention will be described with reference to the drawings.

Embodiment 1

Figure 1:
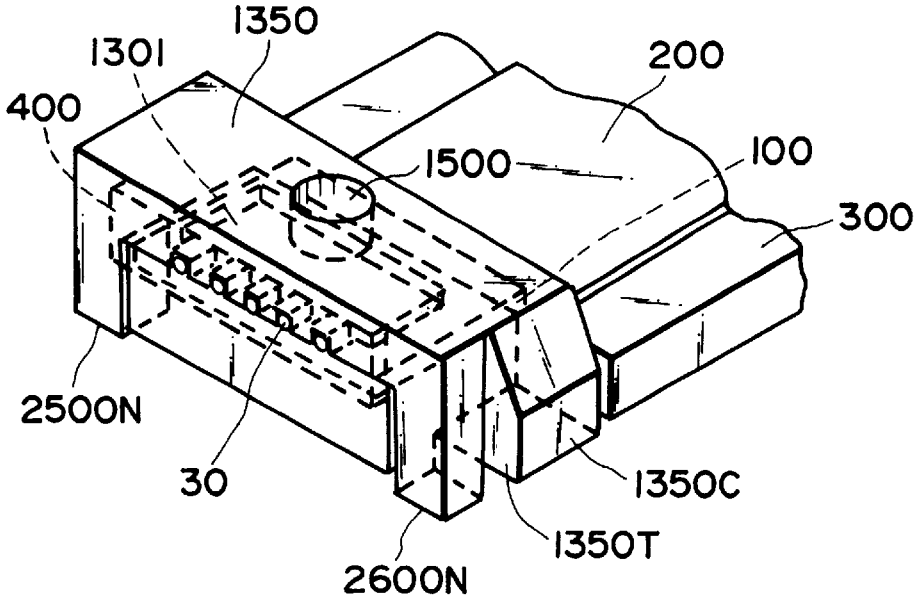
FIG. 1 is a partial perspective view of an embodiment of the ink jet recording apparatus head cartridge in accordance with the present invention.
Figure 2:
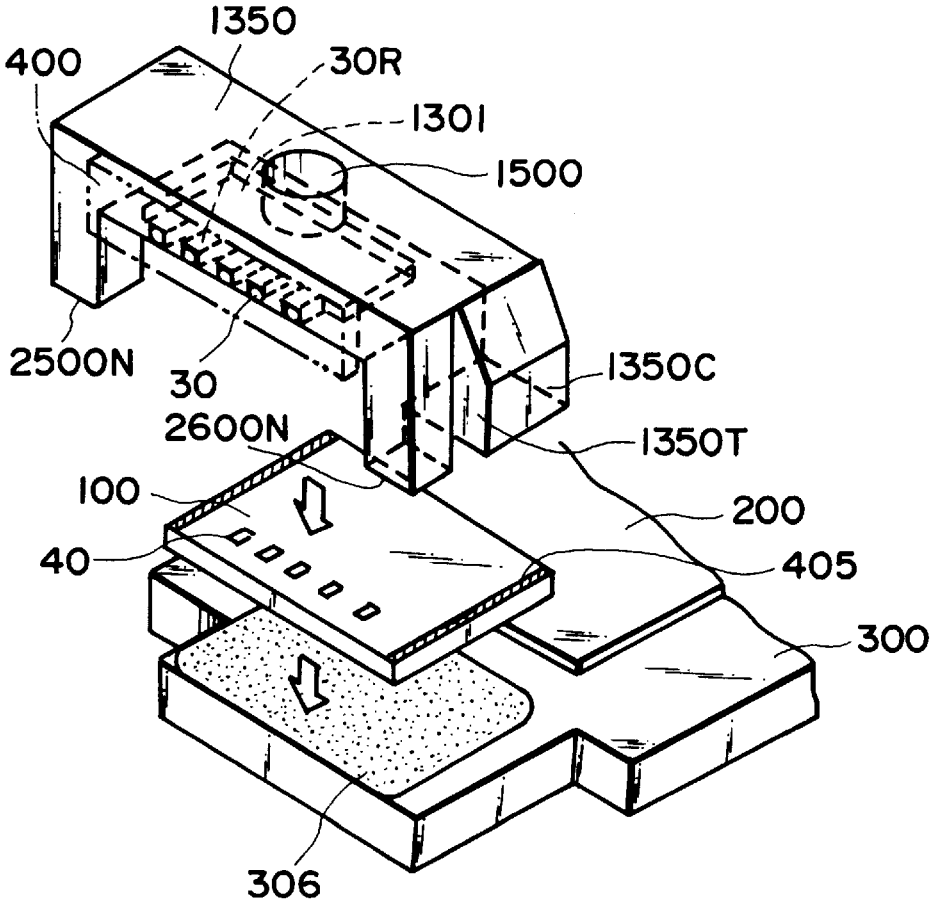
FIG. 2 is an exploded perspective view of the embodiment of the ink jet recording apparatus head cartridge in accordance with the present invention.
Figure 3:
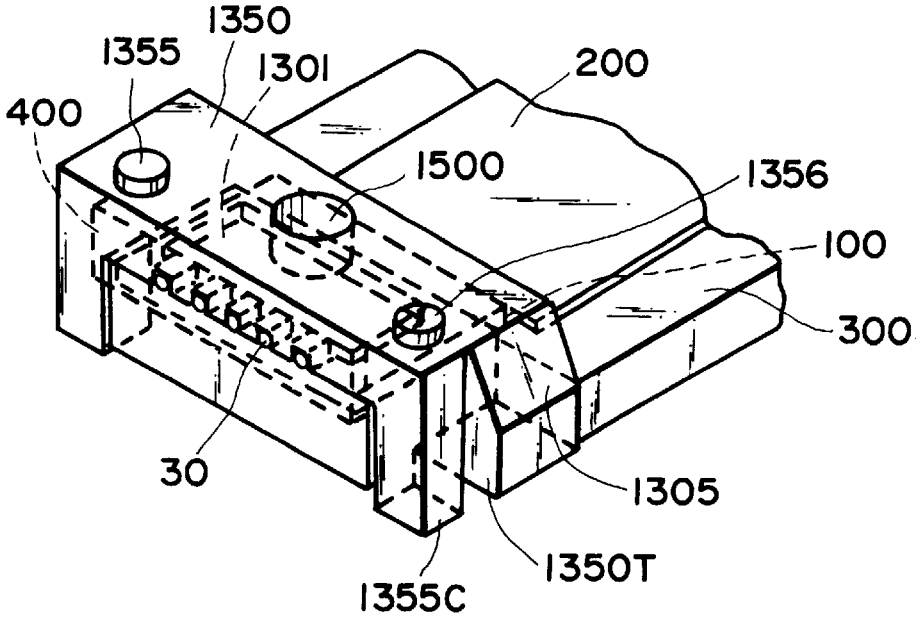
FIG. 3 is a partial perspective view of the second embodiment of the ink jet recording apparatus head cartridge in accordance with the present invention.
Figure 4:
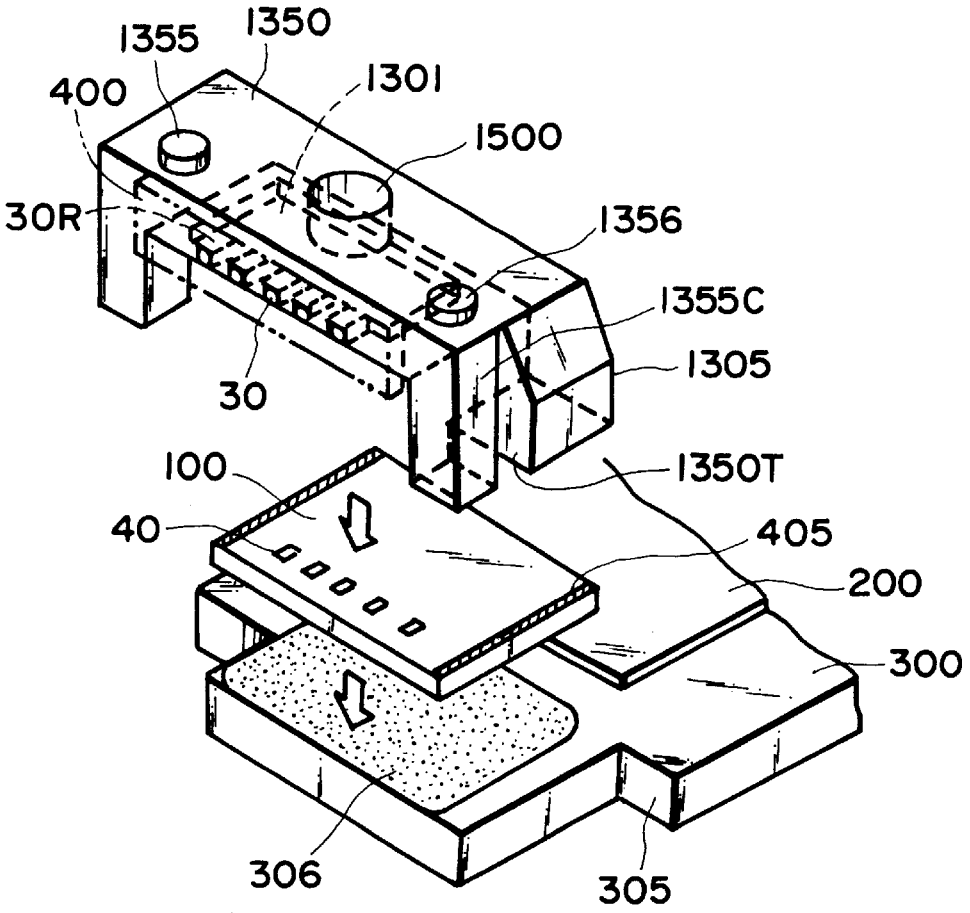
FIG. 4 is an exploded perspective view of the second embodiment of the ink jet recording apparatus head cartridge in accordance with the present invention.
Figure 5:
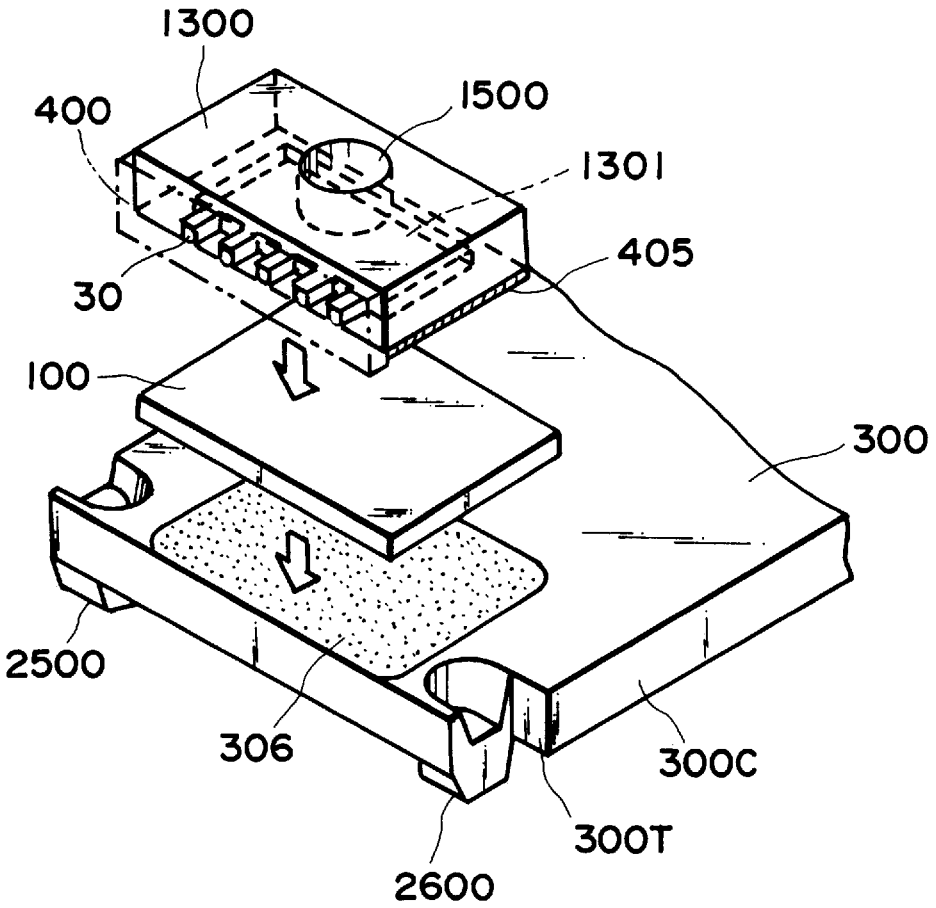
FIG. 5 is an exploded perspective view of a conventional ink jet recording apparatus head cartridge.

FIG. 1 is a schematic perspective view of the first embodiment of the ink jet head cartridge in accordance with the present invention, depicting the structure of the ink ejection section and its adjacencies. FIG. 2 is an exploded, schematic perspective view of the ink jet head cartridge illustrated in FIG. 1.

Referring to FIG. 2, the head cartridge comprises plural electrothermal transducers 40 as energy generation elements, which are placed one for one in liquid paths to eject recording liquid (ink) from plural ejection orifices 30 aligned in a predetermined manner. As a driving signal is sent in, a voltage is applied to the electrothermal transducer 40. As a result, the electrothermal transducer 40 generates thermal energy, which triggers film boiling of the ink, developing bubbles within the ink path. As the bubbles grows, the liquid ink is ejected from the ejection orifice 30.

A grooved top plate 1350 is provided with plural ink paths, a recess, which constitutes a part of a common liquid chamber 1301 for temporarily storing the ink to be supplied to the ink paths, an ink entrance port 1500, through which the ink from an ink container (unillustrated) is introduced into the common liquid chamber 1301, and an ejection orifice plate 400 with plural ejection orifices 30 matched one for one with the ink paths. They are formed as integral parts of the grooved top plate 1350. As for the material for the grooved top plate 1350, polysulfone is preferable because of its ink resistance, but other moldable resin material such as polyethersulfone, polyphenyleneoxide, polypropylene, and the like may be employed.

The heater board 100 comprises a silicon substrate, a heat generation resistor layer formed on the silicon substrate, and an electrode layer also formed on the silicon substrate, wherein the heat generation resistor layer constitutes the electrothermal transducers 40. The heat generating resistor layer and electrode layer are formed using the film deposition technology developed in the semiconductor field. The support member 300 for supporting the heater board 100 is formed of highly heat conductive material such as aluminum, so that the excessive heat generated from the electrothermal transducers 40 can be quickly radiated. The heater board 100 is glued to the support member 300, being positioned thereon with accuracy merely sufficient to prevent the heater board 100 from protruding from the edges of the support member 300. In this embodiment, the positional relationship between the ink jet apparatus and head cartridge is fixed by the grooved top plate; therefore, such high accuracy as described above is unnecessary when the heater board 100 and support member 300 are joined.

A wiring substrate 200 is adhered to the support member 300, with adhesive or the like. One end of the wiring board 200 is connected to the wiring section of the heater board 100, and the other end of the wiring board 200 is provided with plural pads (unillustrated), which are matched one for one with the electrothermal transducers 40 so that the electrical signals from the apparatus main assembly can be supplied to each electrothermal transducer 40.

When joining the heater board 100 and grooved top plate 1350, first, they are temporarily held together, with temporary adhesive 405 after being abutted to each other, and then, the entire interface area between two components is sealed with permanent sealing agent (unillustrated).

In order to attain such an accurate positional relationship between the mutually abutted heater board 100 and grooved top plate 1350 that the positional error of the electrothermal transducer 40 becomes no more than $\pm 10\ \mu m$, the abutting portion (unillustrated) of the top plate 1350 is integrally formed with ink paths 30R.

In this first embodiment, the positioning reference portion, which is used for fixing the position of the head cartridge formed as described above, relative to the carriage or the like of the ink jet apparatus, is formed in the following manner, on the grooved top plate, in which the ejection orifices are formed.

The positioning reference 1350T in the ink ejection direction is constituted of an external surface of the top plate. This surface is perpendicular to the ink ejection direction (substantially parallel to the ejection orifice plate), and is recessed from the ejection orifice plate as seen from the ejection orifice plate side. This is due to the fact that the ejection orifice plate must be formed to be extremely thin so that the distance between the electrothermal transducer and ejection orifice is reduced, and the accuracy of the ejection orifice can be secured, and therefore, the positioning reference in the ink ejection direction cannot be disposed on the ejection orifice plate, and another fact that when the ejection orifice surface is used as the positioning reference in the ink ejection direction, the distance between the ejection orifice and print medium is increased by a distance equal to the thickness of the abutment member, which must be provided on the apparatus main assembly side to be placed in contact with this positioning reference (ejection orifice surface), and as a result, print quality is degraded. In other words, when the positioning reference in the ink ejection direction is constituted of the surface described above, not only can the distance between the ejection orifice and print medium be reduced, but also, the strength of the positioning reference can be increased. As a result, it is possible to provide a highly reliable head cartridge capable of producing high quality print. The positioning reference 1350C in the direction perpendicular to the line of ejection orifice alignment is constituted of another external surface of the top plate. This surface is parallel to the ink ejection direction. Further, referential surfaces, which are perpendicular to both references 1350T and 1350C, are constituted of downward facing external surfaces of the top plate; these surfaces are constituted of the downward facing surfaces of the positioning projections 2500N and 2600N, respectively. These positioning references are abutted against the carriage or the like of the ink jet apparatus when the head cartridge is installed in the ink jet apparatus. Further, when the grooved top plate is formed, these referential surfaces are integrally molded with the ink paths 30R, so that their positional errors relative to the ink paths 30R remain within ±10 μm.

According to the first embodiment of the present invention, the positional references of the head cartridge relative to the ink jet apparatus are formed as integral parts of the grooved top plate, in order to improve the accuracy with which the head cartridge is positioned relative to the ink jet apparatus. In other words, the adhesive, which is difficult to manage accurately, is not involved in the positioning of the head cartridge on the carriage or the like of the ink jet apparatus; therefore, it is unnecessary to re-process the positioning references, or to use a highly precise, but costly, assembly apparatus. As a result, it is possible to produce inexpensively a head cartridge of good quality.

Embodiment 2

The second embodiment is characterized in that non-elastic adhesive can be used to mount the head cartridge on the carriage of the ink jet apparatus (to joins the components constituting the head.

In the first embodiment, the referential surfaces, or the like, formed on the positioning projections of the grooved top plate 1350 were on the side, which comes in contact with the carriage of the ink jet apparatus; therefore, when the head cartridge is mounted on the carriage or the like of the ink jet apparatus, these referential surfaces must be pressed against the carriage, and this pressure affects the ejection orifices 30 and their adjacencies. In fact, this pressure is only approximately 200 g, but in order to cancel the effect of this pressure, adhesive with elasticity must be employed as adhesive 306, which is used to join the heater board and support member 300, so that the pressure imparted on the support member can be absorbed.

Thus, in this second embodiment, the positioning references, which are equivalent to the positioning projections 2500N and 2600N in the first embodiment, are not formed on the side, which comes in contact with the carriage. Instead, they are formed on the opposite side. More specifically, the positioning references in the second embodiment are formed in the following manner.

The positioning references 1350T in the ink ejection direction is formed in the same manner as the first embodiment, that is, it is constituted of the external surface of the top plate, which is perpendicular to the ink ejection direction.

The positioning reference 1350C is constituted of the external lateral surface of the top plate, which is parallel to the ink ejection direction, and joins the ejection orifice surface.

The referential surfaces perpendicular to both positioning references 1350T and 1350C are constituted of the top surfaces of the positioning projections 1355 and 1356 formed on the top surface of the top plate.

In addition, an abutment portion 1305 is formed, which abuts against an abutment portion 305 formed on the support member 300.

These positioning references and the ink paths 30R are molded together as integral parts of the grooved top plate 1350, so that the error in their positional relationship remains within ±10 μm.

In this second embodiment, when the grooved top plate 1350 is molded so accurately that the error in perpendicularity between the positioning reference 1355C in the direction perpendicular to the line of ejection orifice alignment, and the aforementioned referential surface constituted of the top surface of the positioning projection 1356, falls within ±10 μm, the head cartridge can be accurately positioned without involving the other positioning projection 1355.

In other words, when the ink jet cartridge is mounted in the recording apparatus, the position of the cartridge in the ink ejection direction is fixed by the reference 1350T; the position of the cartridge in the direction perpendicular to the line of the ejection orifice alignment is fixed by the reference 1355C; and the position of the cartridge in the direction perpendicular to both of the preceding directions is fixed by the positioning projection 1356.

With the employment of this structure, all of the positioning references can be concentrated in a single corner of the top plate, which makes this structure very advantageous in that it is easier to maintain accuracy in molding the top plate 1350, and also, it allows the portions of the carriage related to the positioning of the head cartridge to be simplified. Therefore, the head cartridge, as well as the ink jet apparatus itself, can be inexpensively produced.

When this head cartridge is assembled, the heater board 100 is glued to the support member 300, so that the heater board 100 is positioned slightly (approximately 10 μm) off toward the wiring substrate 200 relative to the abutment portion 305. The heater board 100, ejection orifice plate 400, and grooved top plate 1350 are temporarily glued together, with a temporary adhesive 405 after they are abutted to each other. The abutment portion (unillustrated) and ink paths 30R of the top plate are integrally molded so that the positional error, which occurs when these three components are abutted together, remains within ±10 μm. Since the heater board 100 is glued to the support member 300, being displaced by approximately 10 μm toward the wiring substrate 200, the abutment portion 1305 of the grooved top plate 1350 is placed in contact with the abutment portion 305 of the support member 300.

Embodiment 3

Figure 7:
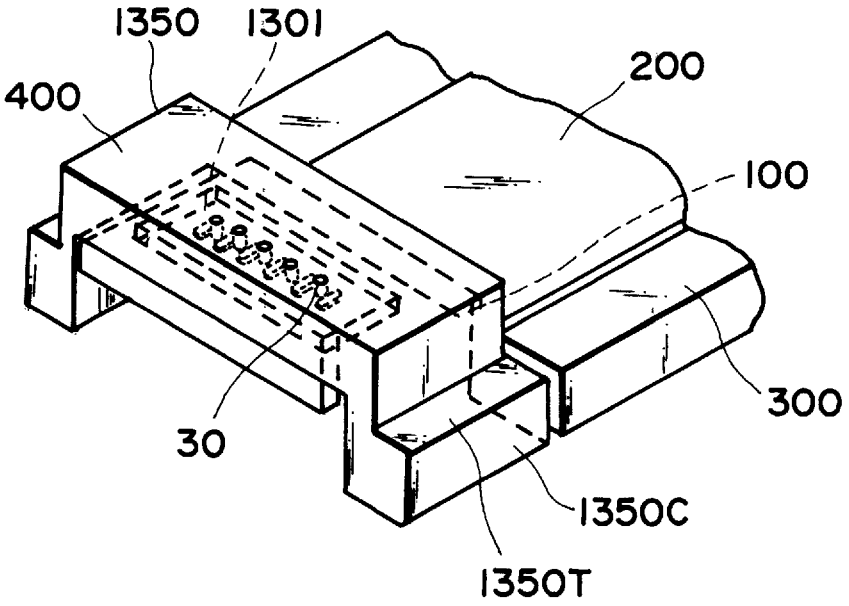
FIG. 7 is a schematic view of a side shooter type head in accordance with the present invention.

In the first and second embodiments, the present invention was embodied as the grooved top plate of a so-called edge shooter type head which ejects ink in the direction perpendicular to the direction in which the bubbles are grown by the electrothermal transducer as the energy generation element. This third embodiment demonstrates that the structure in accordance with the present invention is also applicable to so-called side shooter type heads which eject the ink in substantially the same direction as the direction in which the bubbles are grown by the electrothermal transducer, as shown in FIG. 7.

Figure 6:
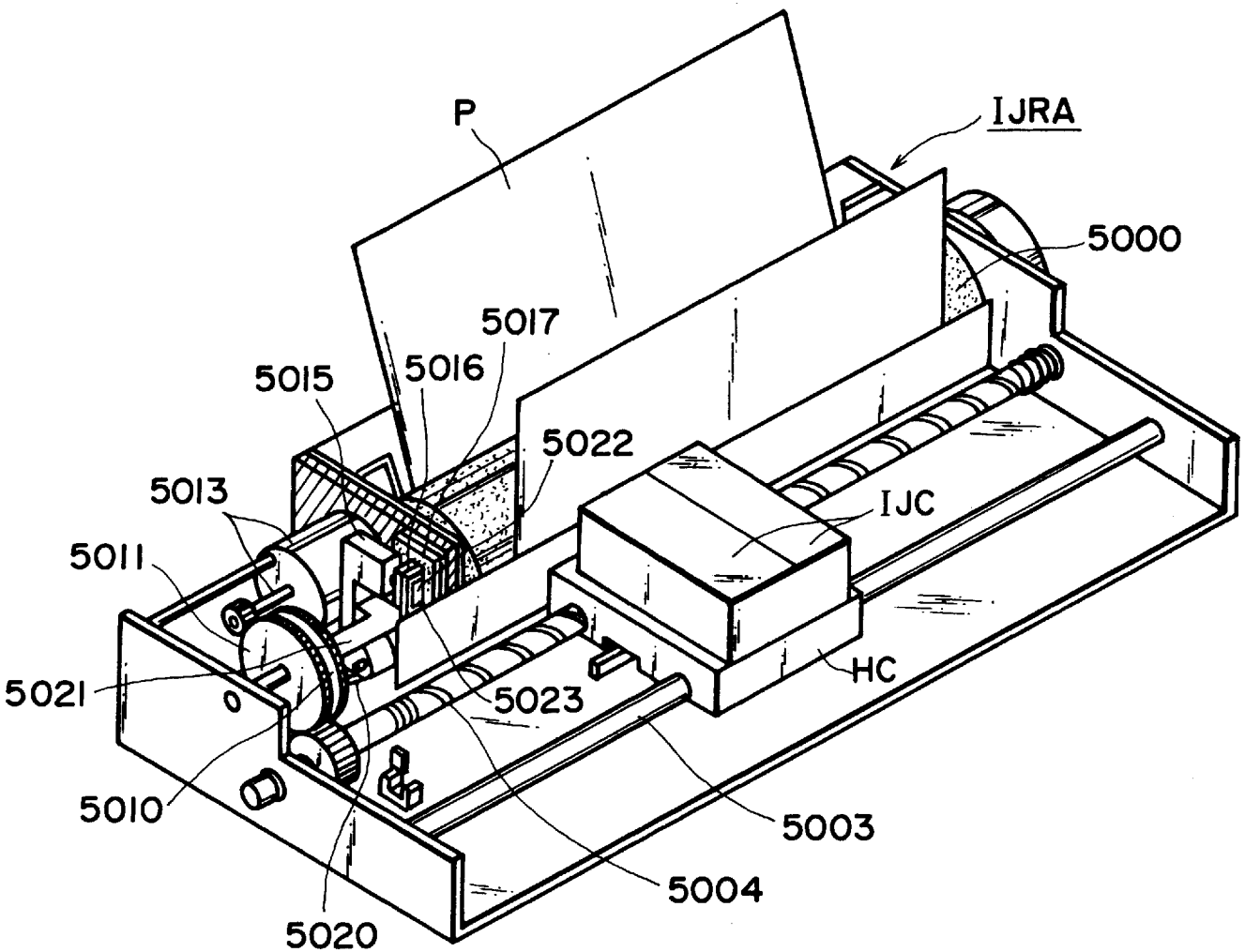
FIG. 6 is an external perspective view of an example of an ink jet apparatus (IJRA), in which the ink jet head, as an ink jet head cartridge (IJC), in accordance with the present invention is mounted.

FIG. 6 is an external perspective view of an example of an ink jet apparatus (IJRA) containing, as the ink jet head cartridge (IJC), the ink jet head embodied in accordance with the present invention.

In the drawing, an alphabetic reference IJC designates ink jet cartridges, each of which is provided with a group of nozzles for ejecting ink toward the printing surface of a print sheet P as printing medium delivered onto a platen 5000. A reference HC designates a carriage which holds the HC. The carriage HC is disposed to slide on two guide shafts 5003 and 5004, which are parallel to each other, and also is connected to the parts of driving gears 5010 and 5011, which transmit the driving force from a driving motor 5013. Therefore, it can be reciprocated across the entire width of the printing paper for the IJC.

The position of each IJC is fixed by abutting an unillustrated positioning member against the abutment portion of the HC.

A reference numeral 5015 designates a head performance recovery apparatus, which is disposed at one end of the moving range of the IJC, for example, at the location opposing the home position of the IJC. The IJC is capped utilizing the driving force of the motor 5013 transmitted through a transmission mechanism 5015; after printing is finished or during the like periods, the IJC is protected by being capped.

A reference numeral 5022 designates a blade as a wiping member, which is formed of silicon rubber, and is placed on one of the lateral surfaces of the head performance recovery apparatus 5016. The blade 5012 is held like a cantilever by a blade support member 5017, and is also driven to come in contact with the ejection orifice surface of the IJC, by the same motor 5013 and transmission mechanism 5015 as the head performance recovery apparatus 5016. With this arrangement, the blade 5022 can be projected into the path of the IJC to wipe away the dew formed by condensation, the wetness, the dust and/or the like, from the ejection orifice surface of the IJC as the IJC moves.

In the above, the present invention was described with reference to a specific type of ink jet head which effects images from the ink droplets, which were ejected from the ejection orifices by the sudden expansion and contraction of the bubbles which were developed as the ink in the ink paths was suddenly heated up by the application of thermal energy to the ink, but the present invention is, obviously, applicable to ink jet heads employing electromechanical transducers as the energy generation elements.

Further, the present invention is particularly effective when used with an ink jet apparatus of a type in which the ink jet head is mounted on the carriage of the ink jet apparatus, but it is also applicable to the ink jet apparatuses employing a full-line type ink jet head, which have a recording width wider than the recording medium width. In addition, when plural ink jet heads in accordance with the present invention are employed to print in color, the ejection orifices of each head can be extremely simply aligned with the ejection orifices of the remainder of the heads.

While the invention has been described with reference to the structures disclosed herein, it is not confined to the details set forth and this application is intended to cover such modifications or changes as may come within the purposes of the improvements or the scope of the following claims.

What is claimed is:

1. An ink jet head comprising:

a top plate comprising a plurality of recesses corresponding to a plurality of ink paths and a liquid chamber, an ejection orifice plate having a plurality of ejection orifices, said ink paths being in fluid communication with said ejection orifices for ejecting an ink, and a positioning reference portion for positioning said ink jet head relative to an ink jet apparatus; and a substrate in contact with said top plate, said substrate having a plurality of energy generation elements for generating energy to eject the ink;

wherein said ink paths and said liquid chamber are defined by said recessed and said substrate.

2. An ink jet head according to claim 1, wherein said recesses, said ejection orifice plate, and said positioning reference portion are integrally formed.

3. An ink jet head according to claim 2, wherein said top plate is formed of resin.

4. A recording head for an ink jet recording apparatus according to claim 1, 2, or 3, wherein said positioning reference portion is the positioning reference portion relative to the ink jet recording apparatus.

5. A recording head for an ink jet recording apparatus according to claim 1, 2 or 3, wherein said positioning reference portion comprises at least one of a first positioning reference in an ink ejection direction, a second positioning reference in a direction perpendicular to a line of ink ejection orifice alignment, and a third positioning reference perpendicular to both the ink ejection direction and the direction perpendicular to the line of ink ejection orifice alignment.

6. A recording head for an ink jet recording apparatus according to claim 5, wherein all of the positioning references of said positioning reference portion are disposed at a single location of said top plate.

7. A recording head for an ink jet recording apparatus according to claim 5, wherein said third positioning reference is formed on at least one positioning projection projecting from said top plate.

8. A recording head for an ink jet recording apparatus according to claim 5, wherein said third positioning reference is formed on a vertical positioning projection projecting from said top plate.

9. A recording head for an ink jet recording apparatus according to claim 5, wherein said third positioning reference is formed on a positioning projection projecting from said top plate.

10. A recording head for an ink jet recording apparatus according to claim 5, wherein said first positioning reference in the ink ejection direction is constituted from one of the surfaces of the top plate projection, which is recessed from said ejection orifice plate in the ink ejection direction, and is substantially parallel to said ejection orifice plate.

11. An ink jet apparatus comprising:

a carriage for mounting said ink jet head according to claim 1, said carriage comprising;

an abutment portion against which said positioning reference portion of said ink jet head abuts.

* * * * *

UNITED STATES PATENT AND TRADEMARK OFFICE

CERTIFICATE OF CORRECTION

PATENT NO. : 5,821,961

DATED : October 13, 1998

INVENTOR(S): OSAMU SATO

It is certified that error appears in the above-identified patent and that said Letters Patent is hereby corrected as shown below:

COLUMN 7

Line 21, "5015" should read --5016--.

COLUMN 8

Line 17, "recessed" should read --recesses--.

Signed and Sealed this

Sixteenth Day of November, 1999

*Attest:*

Q. TODD DICKINSON

*Attesting Officer*

*Acting Commissioner of Patents and Trademarks*